US006772980B2

(12) United States Patent
O'Neill

(10) Patent No.: US 6,772,980 B2
(45) Date of Patent: Aug. 10, 2004

(54) ERGONOMIC APPARATUS FOR PERSONAL COMPUTER USE

(76) Inventor: John M. O'Neill, 7303 Eden Brook Dr., Columbia, MD (US) 21046

( * ) Notice: Subject to any disclaimer, the term of this patent is extended or adjusted under 35 U.S.C. 154(b) by 0 days.

(21) Appl. No.: 10/310,848

(22) Filed: Dec. 6, 2002

(65) Prior Publication Data

US 2004/0108422 A1 Jun. 10, 2004

(51) Int. Cl.[7] ..... B43L 15/00

(52) U.S. Cl. ..... 248/118.1; 248/118; 248/118.5; 248/918; 224/201; 224/930; 108/43

(58) Field of Search ..... 248/118.5, 118.1, 248/444, 918, 118; 224/201, 265, 266, 270, 259, 930; 108/43

(56) References Cited

U.S. PATENT DOCUMENTS

| | | | | |
|---|---|---|---|---|
| 4,621,781 | A | 11/1986 | Springer | 248/118 |
| 5,137,384 | A | 8/1992 | Spencer et al. | 400/489 |
| 5,311,210 | A | 5/1994 | O'Brien et al. | 345/168 |
| 5,443,237 | A | 8/1995 | Stadtmauer | 248/441.1 |
| 5,509,628 | A | 4/1996 | Noble | 248/118 |
| 5,582,375 | A | 12/1996 | Martin | 248/118.3 |
| 6,045,098 | A | 4/2000 | Timm | 248/118 |
| 6,132,118 | A | 10/2000 | Grezeszak | 400/489 |
| 6,148,739 | A | 11/2000 | Martin | 108/50.01 |
| 6,183,149 | B1 | 2/2001 | Caplan | 400/489 |
| 6,315,472 | B1 | 11/2001 | Muller | 400/472 |
| 6,325,342 | B1 | 12/2001 | Dignat | 248/118 |
| 6,336,614 | B1 | 1/2002 | Kwitek | 248/118 |
| 6,402,100 | B1 | 6/2002 | Rice | 248/118 |
| 6,454,224 | B1 | 9/2002 | Nogueira | 248/118.5 |
| 6,460,816 | B1 | 10/2002 | Barber | 248/284.1 |
| 2001/0038524 | A1 | 11/2001 | Howell et al. | 361/683 |
| 2002/0002935 | A1 | 1/2002 | Lease et al. | 108/43 |
| 2002/0074836 | A1 | 6/2002 | Sher et al. | 297/188.18 |
| 2002/0109667 | A1 | 8/2002 | McAlindon | 345/156 |

*Primary Examiner*—Kimberly Wood
(74) *Attorney, Agent, or Firm*—William S. Ramsey

(57) ABSTRACT

The inventive apparatus is a convenient, unobtrusive appliance for providing support in the prevention of injury due to personal computer keyboard use. In particular, the inventive apparatus supports the entire arm and further assists the keyboard user in that it allows the shoulder muscles to remain relaxed, and the knuckles, wrists, and forearms to maintain the same plane during keyboard usage. Further, the inventive apparatus is designed to support and maintain good posture at the keyboard. The inventive apparatus is worn by a user on the user's upper body and it receives it support from the wearer's waist and upper back, while avoiding contact at the wearer's shoulder and neck. It supports both arms and the upper body without encumbering the wearer of the apparatus. The inventive apparatus supports the wearer's upper body movements by acting as a suspension system in that it absorbs the damaging energy that so often is the initial cause of repetitive stress injury to keyboard users.

13 Claims, 5 Drawing Sheets

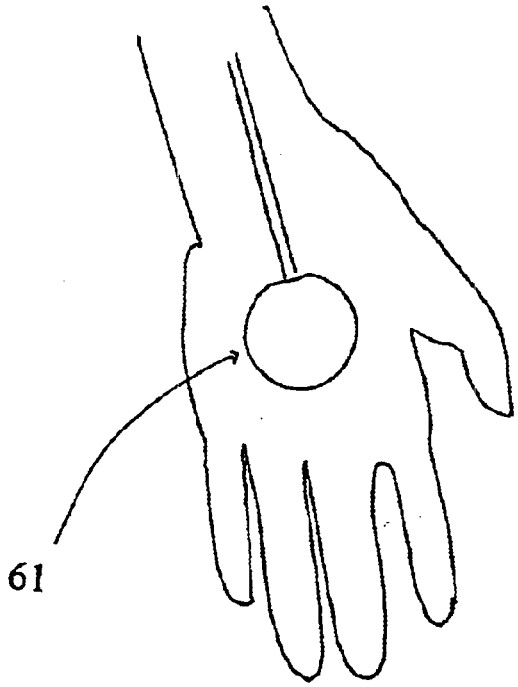
Fig. 4A
Fig. 4B
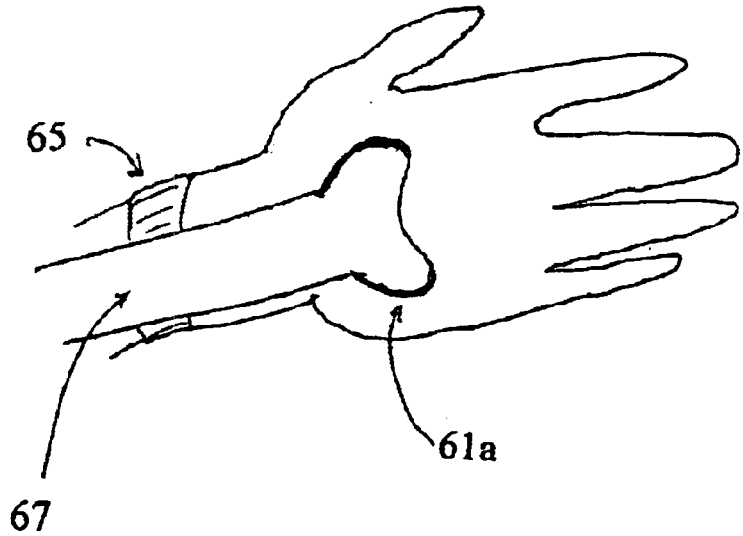

ERGONOMIC APPARATUS FOR PERSONAL COMPUTER USE

BACKGROUND OF THE INVENTION

1. Field of the Invention

The present invention relates to keyboard support systems and in particular to an ergonomic keyboard support apparatus that is designed to be worn by a person using a personal computer or other keyboard device to alleviate the tension and stress damage that can occur in the upper body of the user when engaged in typing or keying.

2. Description of Related Art

While typing on a personal computer keyboard may appear to be a low impact activity, the lack of bodily motion and presence of high repetitions and awkward postures can lead to pain and injury if not recognized and dealt with. Unlike typing at a typewriter, where a typist occasionally pauses to make corrections by hand, roll paper into and out of the carriage, or manually look up a word in a dictionary, the physical movement of typing at a personal computer is more intently repetitive. In particular, there are fewer "wrist rest" times with computing. Although the single motion upon a touch-sensitive key involves only a minimal amount of pressure, it is the cumulative effect of continuous typing over an extended period without adequate recovery time that may result in pain, inflammation and swelling.

The resultant injuries to the wrists, and other areas of the upper body, have been characterized as Repetitive Strain Injuries (RSI). The term "Repetitive Strain Injury" has evolved as these injuries are due to repetitive activities performed continually over time. The RSI designation is an umbrella term for a number of stress injuries affecting the soft tissues; i.e. muscles, tendons, nerves, etc. Carpal Tunnel Syndrome (CTS), affecting the wrists, is the most highly publicized RSI, but other repetitive stress injuries can show up in the balance of the shoulder and neck area. Treatments for keyboard-associated RSIs can vary from rest, medications, physical therapy and/or surgery.

These injuries translate not only into pain and potential disability for the affected users, but also into significant loss of money, time and productivity for businesses. Of course, Workman Compensation and private insurers are also being hit hard by these claims. Carpal Tunnel Syndrome and other cumulative trauma disorders are the fastest growing category of occupational injuries in the United States. RSI has become an expensive condition troublesome for both employee and industry.

The human and economic costs of unhealthy postures and RSI diseases have been widely documented in corporate, scientific and governmental literature. The U.S. Federal agency OSHA (Occupational Safety and Health Administration) reports that an increasingly greater number of workers are injured each year by RSI diseases caused by computer usage, resulting in a large amount of time and money devoted to therapeutic treatment and recovery time, resulting in lost productivity. The cost of repetitive strain injuries is enormous, not only in medical claims but also in lost time and retraining expenses.

Prevention measures are the best productivity-enhancing approach to solving this problem, as these injuries are often preventable if correct hand/wrist/forearm/shoulder (trapezious muscle) posture is maintained by the keyboard user. "Ergonomics" is the science of fitting a job to a worker, and prevention of such work-related injuries is the goal of ergonomics.

The most obvious problem with extended repetitive keyboard use is strain on the wrists. When using a conventional keyboard, the user must pronate his/her wrists to a horizontal place and angle them inward with palms down and fingers aligned with the straight row of keys. Also, when the user instinctively rests his or her arms due to lapses in work, or fatigue, he or she will tend to rest them directly on the wrist, further putting pressure on the median nerve. Maintaining the wrist in an awkward position during repetitive keyboard motions increases the likelihood of injury.

Another area affecting RSI, particularly CTS, is the position of the forearms. With a conventional keyboard, the forearms may be even with or higher than the elbows. This creates considerable strain when the user must use the keyboard for long periods of time. However, if the hands are held lower than the elbows, such as by putting the keyboard on the lap, muscles on the top of the forearm must work harder to keep the fingers raised up into position.

Other RSIs can arise from the unnatural position of the shoulder joints. When using a conventional keyboard, they are rotated slightly forward and often bear the weight of the arms for long periods of time. The neutral position of the shoulders is when the elbows are down by the operator's sides. Muscle strain in the shoulder/neck area and subsequent headaches can be caused by holding the shoulders in an unnatural forward and inward rotated position when operating a conventional keyboard. Holding the body and upper extremities in these static positions associated with keyboard use and data input greatly increases the likelihood of injury.

RSIs result from a mix of poor keyboarding posture and technique, faulty workstation design and current keyboard and mouse arrangements. The goal of ergonomics is to decrease both force and repetition, and achieve good posturing and good support.

Several types of devices have been developed to promote keyboard ergonomics. Various devices upon which the wrist or base of the hand is rested while typing to support the wrist have become very widespread. However, with a conventional wrist rest, the wrist is typically forced to bend upwards to place the fingers on the keys. Consequently, the muscle and tendons in the hands, wrists, arms, neck and shoulders must continually support the fingers in this upward angle.

Forearm supports that attach to a computer workstation or desk for cushioning arms during keyboard use have been developed. Keyboard supports capable of positioning the keyboard at a better angle and distance for the user have also been developed.

Office furniture and office product manufacturers offer a wide variety of products that are marketed as ergonomic. For example, some manufacturers make adjustable-height tables and desks, and adjustable keyboard and mouse supports. Several manufacturers offer office furniture that provides convenient arrangements of the computer and keyboard, such as retractable shelves positioned below a desktop for either storing or extending the keyboard toward the operator. However, these shelves have limited mobility and still require the operator to extend his or her arms in an unsupported position to reach the keyboard, which eventually causes fatigue in the arms and shoulders.

Computers, chairs and workstations are continually being redesigned to reduce the inconvenience and discomfort of office workers such that each of the devices is ergonomically designed and comfortable to use. However, current ergonomic devices are directed at protecting keyboard users' bodies in a piecemeal fashion. In addition, the cost of purchasing enough ergonomically designed computer equipment and ergonomic appliances to provide additional support can be quite expensive, as several appliances are needed to support every area of the upper body. Furthermore, ergonomic furniture solutions and other ergonomic devices are typically made in a one-size-fits-all fashion.

Existing pads, braces, platforms and the like address one or just a portion of the user's concerns when using a keyboard. These "spot devices", if effective, tend to move the trauma to other areas of the body. There is currently no entire upper body stress protection device. Moreover, none of these spot devices move with the body of the user. Most are stationary devices that provide no support whenever the user moves his or her body. This inability to accommodate movement puts the user at risk of injury.

There have been many attempts to develop a keyboard support that would combine several advantages for the keyboard user. For example, U.S. Pat. No. 6,454,224 to Nogueira discloses an armrest assembly that supports a user's forearms and wrists while substantially allowing full mobility of the user's arms and hands to enable the user to use a keyboard and mouse. The disclosed armrests move laterally and longitudinally relative to the keyboard, swivels and tilts. However, the user is still constrained to the armrest assembly, which is fixed.

Since using a keyboard requires a certain amount of upper body freedom, it has been difficult to design practical safety equipment that will follow the user's movements and safeguard each of the movements with needed support. Wrist supports, keyboard pads, specially designed mice, etc are all "spot devices" that do not move with users as they work at computers.

Thus, what is needed is a support that moves with the arms so that at any position there is ample support for each vital part of the limb. What is needed is an apparatus that supports and protects all portions of the human body that tend to incur damage due to the repetitive motion of keyboard usage that is capable of moving with the keyboardist to provide support throughout the expected range of motion. An apparatus that promotes good posture would also provide an additional safeguard to keyboard users. The apparatus of the present invention is a preventative aid for keyboard users as it provides consistent, constant support while it accompanies the user's motions. It interrupts and muffles the repetitive damage that is the cause of these RSIs.

SUMMARY OF THE INVENTION

The present inventive apparatus is a convenient, unobtrusive appliance for providing support to the entire upper body thereby preventing injury due to repetitive activity from keyboard usage. In particular, the inventive apparatus supports the entire upper body of the keyboard user.

The inventive apparatus is designed to support and encourage good posture while working at a personal computer keyboard. The inventive device is placed substantially in front of the upper body of the user, and receives the small amount of support it needs from the wearer's waist and upper back, while avoiding contact with the shoulder and neck. It supports both arms and upper body without encumbering the wearer of the apparatus.

The inventive apparatus supports the wearer's upper body movements by acting as a suspension system absorbing energy as it shadows the wearer's movements. The force of the wearer's fingers impacting the keyboard keys is substantially redirected to the frame of the apparatus, and therefore less impact is absorbed by the wearer's soft tissue. The inventive apparatus is unique in its ability accompany movement and protect the entire upper body during keyboard usage.

An additional feature of the inventive apparatus provides for a computer mouse console, thereby eliminating the need for the wearer to reach for, handle and operate the mouse. By mounting a mouse console in the inventive apparatus, the wearer of the apparatus does not have to disengage from the keyboard to operate the mouse. This unique feature eliminates the damage done when the wearer interrupts typing to reach for and use the mouse.

In accordance with one form of the present invention, there is provided an ergonomic apparatus for supporting a user of a keyboard, wherein the apparatus is comprised of: a central post; a shoulder assembly connected to an upper end of the central post; a waist bar connected to a lower end of the central post; wherein the shoulder assembly maintains contact with the user's back, and the waist bar supports the user's forearms and upper body as the user uses the keyboard.

There is also provided an ergonomic apparatus to be worn by a computer user for supporting the user's upper body while using a keyboard connected to a computer, wherein a first end of the apparatus is in contact with the user through at least two members resting on the user's back, and wherein a second end of the apparatus supports the user's forearms and upper body as the user uses the keyboard.

Accordingly, the present invention provides solutions to the shortcomings of prior ergonomic spot devices. Those of ordinary skill in the art will readily appreciate, therefore, that those and other details, features, and advantages will become apparent in the following detailed description of the preferred embodiments.

DESCRIPTION OF THE FIGURES

The accompanying drawings, wherein like references numerals are employed to designate like parts or steps, are included to provide a further understanding of the invention, are incorporated in and constitute a part of this specification, and illustrate embodiments of the invention that together with the description serve to explain the principles of the invention.

In the figures:

FIG. 4A illustrates an under view of the palm rest in one embodiment.

FIG. 4B illustrates an under view of the palm rest in another embodiment.

DETAILED DESCRIPTION

Reference will now be made in detail to the preferred embodiments of the present invention, examples of which are illustrated in the accompanying drawings. It is to be understood that the Figures and the description of the present invention included herein illustrate and describe elements that are of particular relevance to the present invention, while eliminating, for purposes of clarity, other elements that may be found in other ergonomic devices.

It is worthy to note that any reference in the specification to "one embodiment" or "an embodiment" means that a particular feature, structure or characteristic described in connection with the embodiment is included in at least one embodiment of the invention. The appearances of the phrase "in one embodiment" in various places in the specification are not necessarily all referring to the same embodiment.

The apparatus disclosed herein is described in terms of using a computer keyboard, but as one skilled in the art will realize, the apparatus can be used in many different contexts, such as supporting the upper body while playing a musical keyboard or other instrument, or supporting the upper body during a video game where a joystick or other device is used. It is intended that any of these alternative uses come within the scope of the present invention.

The apparatus of the present invention is an ergonomic safety appliance that a user wears when working at a personal computer or other keyboard device. It is designed to protect against and avoid the strain damage that can occur in the upper body of a computer user during extensive keyboard typing.

The present invention supports the upper body during keyboard use such that tension and stress is reduced throughout the entire upper body of the user and good posture is encouraged. When wearing the inventive apparatus, the user is unencumbered as the apparatus is completely integrated with the user's body.

As the inventive apparatus is worn on the body of the user, it dynamically follows the working motions of the lower arm thereby alleviating stress placed on the lower arm, resulting in less fatigue and fewer injuries. Additionally, the inventive apparatus supports the user's hand and follows the natural movement of the hand and fingers as they flex, extend, contract, etc. in order to manipulate a keyboard or other work piece.

Figure 1:
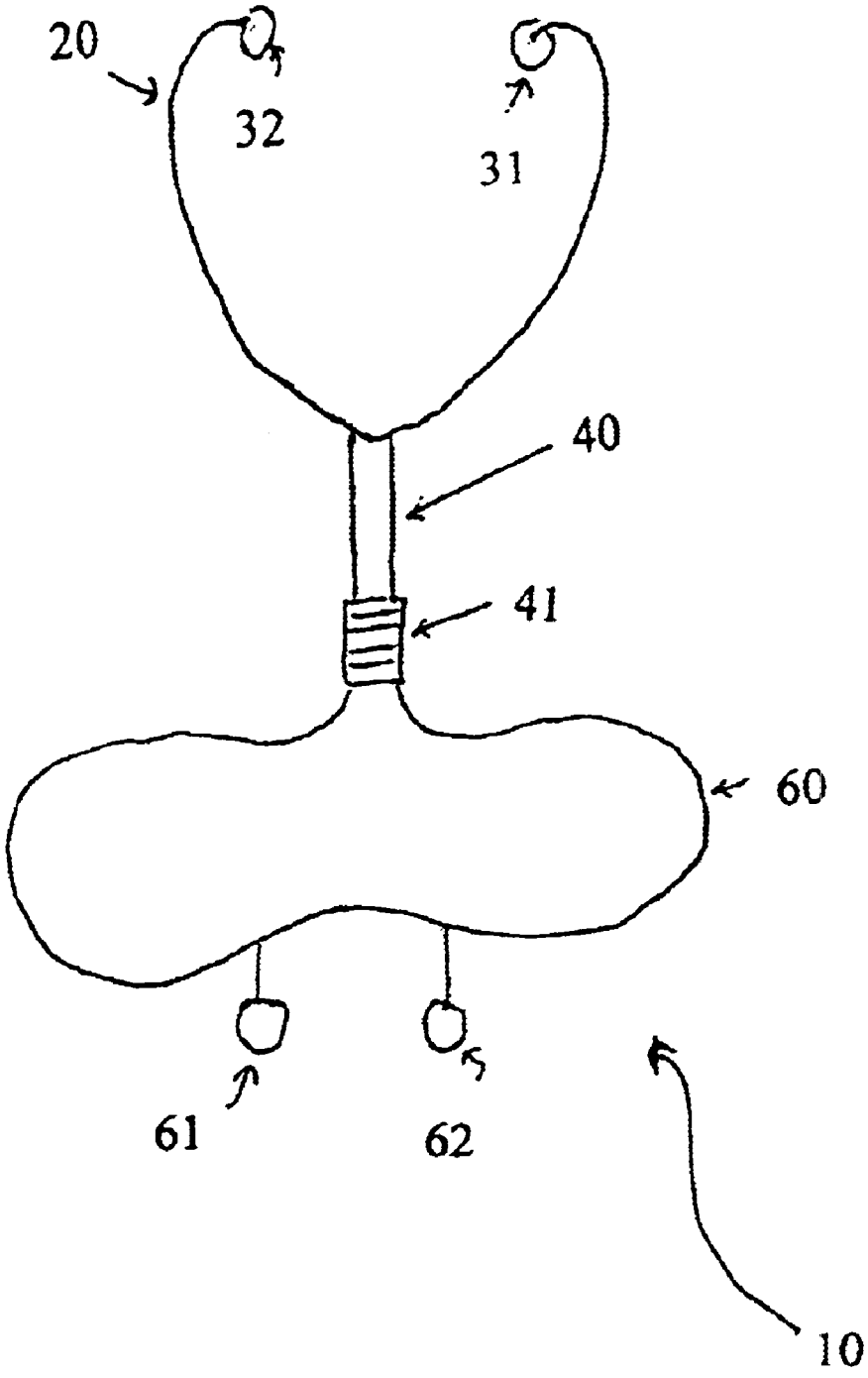
FIG. 1 illustrates the ergonomic keyboard support apparatus of the present invention.
Figure 3:
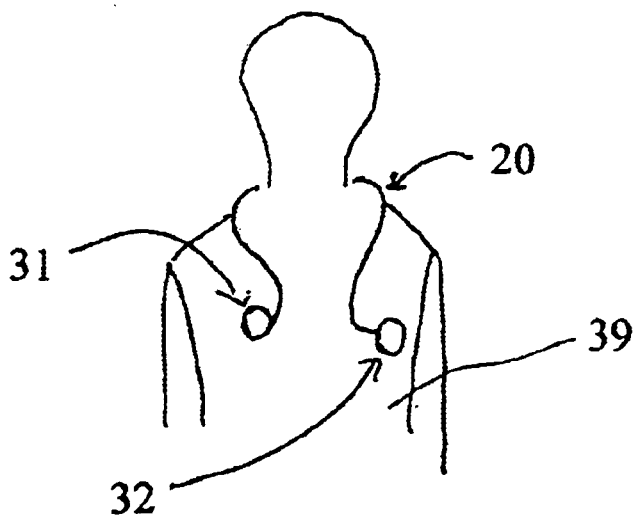
FIG. 3 illustrates a rear view of a user wearing the ergonomic keyboard support apparatus of the present invention.

As shown in FIG. 1, inventive apparatus 10 is comprised of three sections. Shoulder assembly 20 extends over the shoulders of the wearer of the inventive apparatus and obtains support from the back of the wearer. Shoulder assembly 20 is in contact with the rear shoulder area 39 of the user, as shown in FIG. 3. As shown, in a preferred embodiment, ends 31, 32 of the shoulder assembly 20 rest upon the user's back 39, and are padded for the user's comfort. No part of the inventive device is intended to touch the user's body except for ends 31, 32 and waist bar 60. In particular, the shoulder assembly should not touch the neck, or the upper and front shoulder areas, as there are small blood vessels in these areas that can be damaged from pressure to these areas. In a preferred embodiment, there is padding on the underside of the shoulder assembly to further guard against any pressure that may be inadvertently exerted from the inventive apparatus to these sensitive areas.

Figure 2:
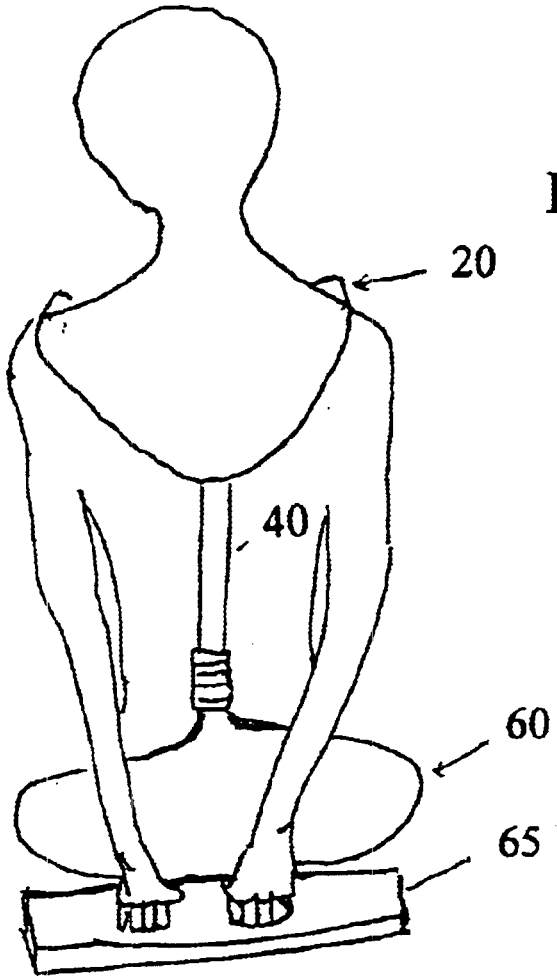
FIG. 2 is a front view of the ergonomic keyboard support apparatus of the present invention as worn by a user.
Figure 7:
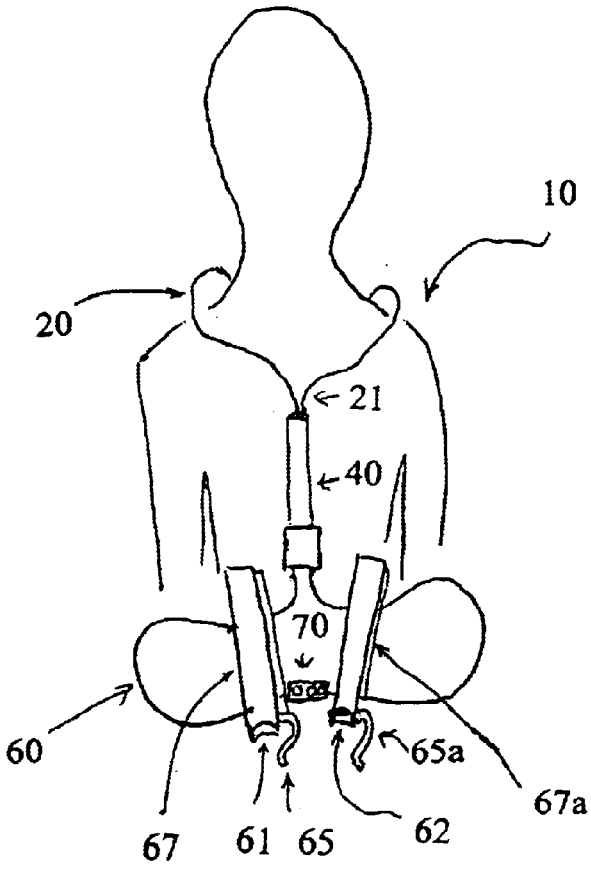
FIG. 7 illustrates a user using the inventive apparatus with the mouse console.

As shown in FIG. 7, shoulder assembly 20 is a single integral component that connects to central post through branch 21. However, in another embodiment, shoulder assembly 20 may be comprised of two arms each connecting to central post 40 in front of the user's body to form the assembly, as shown in FIG. 2. In this embodiment, central post 40 is connected to shoulder assembly at the point where the arms connect. In yet another embodiment, shoulder assembly 20 may be comprised of two arms that connect with a separate piece that is used to connect with central post 40. In yet another embodiment, shoulder assembly 20 may be comprised of more than two arms.

Central post 40 is a shaft-like structure that extends from the chest area of the wearer of the apparatus to the waistline of the wearer. Central post 40 is preferably vertically adjustable. As shown in FIG. 1, telescoping mechanism 41 may be used to adjust the length of central post 40 to better fit the body of the user. Telescoping mechanisms and other mechanism for adjusting the length of a shaft are known to those skilled in the art, and any such mechanism could be used in the inventive apparatus.

Central post 40 connects shoulder assembly 20 to waist bar 60. As will be obvious to one skilled in the art, there are many ways to make these connections. For example, the ends of central post 40 may be press fit into openings provided in shoulder assembly 20 or waist bar 60. Alternatively, threads may be provided at the ends of post 40 for reception into correspondingly threaded openings in assembly 20 or waist bar 60. Alternatively, post 40 may be turned inwardly at the ends to form a channel securing sections of mating end parts. In another embodiment, the entire apparatus is stamped out as a single continuous unit such that connections are not needed. Those skilled in the art will realize that the inventive device can be assembled in a variety of ways that achieve the same functionality.

Waist bar 60 rests on the operator's midsection. Waist bar 60 supports the user's arms when the wearer of the apparatus uses a keyboard 66 or other device, as shown in FIG. 2. Two key areas of concern in keyboard ergonomics are the wrist and hand because they receive much of the damage from keyboard usage. Ergonomists believe that the hands should be in a "neutral" position when typing, i.e. with the knuckles, wrist, and top of the forearm all in the same plane. Stress damage is greatly reduced by keeping the knuckles, wrist and forearms maintained in the same plane while using a keyboard. Waist bar 60 forms a plane in which the forearms, wrists and knuckles of wearer all move, thereby maintaining this plane needed to hold the hands in the favored neutral position. It is a feature of the present invention that the inventive apparatus delivers the fingers to the keyboard in a secure "gliding" fashion that is consistent with ergonomic principles.

In one preferred embodiment, waist bar 60 is additionally comprised of at least one palm rest, shown as palm rests 61, 62 in FIGS. 1 and 7. Palm rests 61, 62 support the user's hand and follow the natural movement of the hand and fingers as they flex, extend, contract, etc. in order to manipulate a keyboard. In a preferred embodiment, palm rests 61, 62 are adjustable for fit and comfort.

Figure 5A:
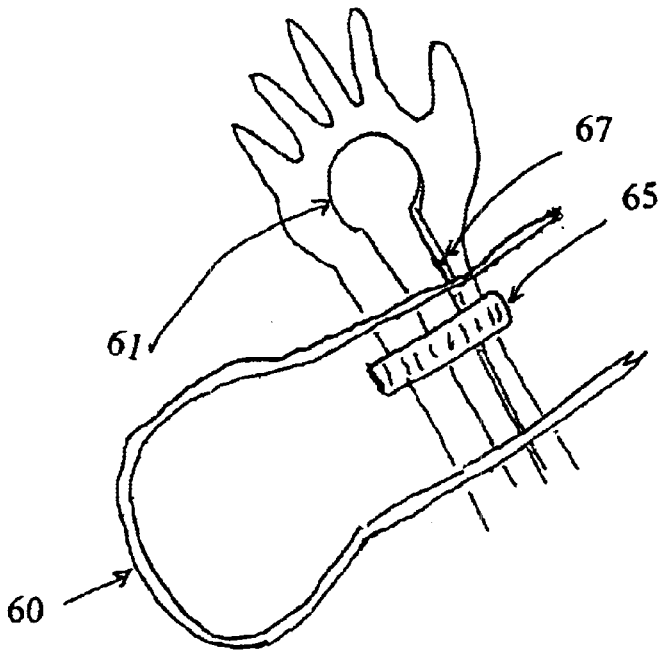
FIG. 5A illustrates a view of the wrist brace and palm rest in one embodiment.
Figure 5B:
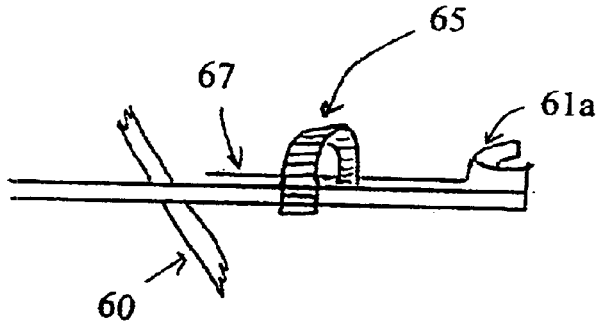
FIG. 5B illustrates a view of the wrist brace and palm rest in another embodiment.

As shown in FIG. 4A, in one embodiment palm rest 61 is a spoon-shaped support used to support the palm when the user is typing at a keyboard. In another embodiment, as shown in FIG. 4B, palm grip 61*a* is used instead. As shown in FIG. 5B, palm grip 61*a* on arm support 67 rises approximately ½" above the surface of arm support 67 to engage and anchor or secure the user's hand so that it is properly positioned at the keyboard.

In another preferred embodiment, waist bar 60 is additionally comprised of at least one wrist brace. FIG. 5A shows waist bar 60 with wrist brace 65 connected to arm support 67. In a preferred embodiment, wrist brace 65 is placed on the top side of waist bar 60, although it can be placed on the under side of the waist bar. In a preferred embodiment, wrist brace 65 is a strap-like piece that is used to secure the operator's wrist in place so that the plane can be maintained between the knuckles, wrist and forearm. As shown in FIG. 7, wrist braces 65, 65*a* are movable and adjustable.

Figure 6:
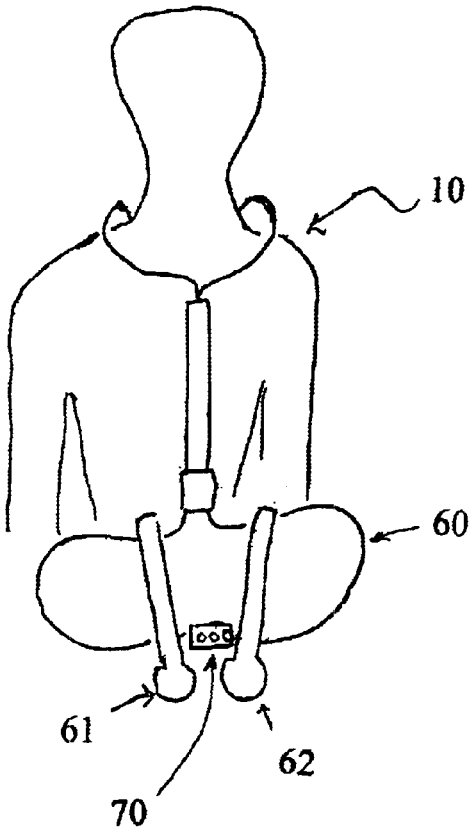
FIG. 6 illustrates an embodiment of the apparatus of the present invention with a mouse console.

In a preferred embodiment, waist bar 60 additionally comprises console 70, as shown in FIGS. 6 and 7. Console 70 can be used to house a wireless or conventional mouse or other device. For example, a calculator, means for opening a safe, or means for turning office lights on and off, etc. could be housed in console 70. In an alternative embodiment, palm rest 61 or 62 could be used to house a mouse or other computer device. In a preferred embodiment, console 70 has built-in mouse buttons space that can be used for mouse operations, eliminating the need for a separate mouse. The console could be wireless or wired to the computer in a similar manner as a conventional mouse. Adjustable arm supports 67, 67*a* are attached to waist bar 60 to support palm rests 61, 62 and wrist braces 65, 65*a*.

By housing the mouse in the waist bar, the user no longer needs to lift his hand off the keyboard to use the mouse, thereby eliminating arm and hand movement to and from the mouse. This innovation will allow the wearer of the inventive apparatus to merely use his or her thumbs and/or fingers to manipulate the console's mouse-like features. The singular movement of reaching and grabbing the mouse has proven to be very damaging to personal computer users. By the features of the inventive apparatus, the need for this movement is eliminated.

The inventive apparatus is preferably constructed of lightweight plastic and foam materials. The components that make up the inventive apparatus are preferably somewhat pliable, so that they may be shaped for comfort, while remaining rigid enough to stay in place during use. Other portions of the apparatus, such as the palm rests and arm supports, are preferably constructed of durable plastic materials known to those skilled in the art. However, it is envisioned that the inventive device can be constructed from many plastic combinations, metal, wood, fiber or almost any material that can be formed to satisfy the palm or other hand gripping surface requirements of the device.

The present invention promotes good posture, which is one of the best guards against RSIs. The inventive apparatus can be molded and adjusted to fit various body types. Most importantly, the apparatus of the present invention "shadows" the wearer's movements providing a unique interactive capability that allows it to follow and support the user's motions. As the user works, the device interrupts and muffles the cumulative trauma to the body of keyboard use and other trauma associated with computing. The inventive apparatus is designed to protect the entire arm and upper body rather than just specific areas, like the wrist or some other part of the arm.

While the inventive apparatus is intended primarily as a device for preventing RSIs, it can also be used to ease the pain of existing injuries or physical complications as it supports the entire upper body during keyboard activities.

In addition, it is a feature of the present invention that the inventive apparatus can be used by persons of all ages and sizes. Typewriters and keyboards were originally developed and designed for the average 25-year old American male. As children become increasingly computer literate, they also need ergonomic support. The inventive apparatus can be sized and used by any person that has the basic physical attributes for the computing task.

Another feature of the inventive apparatus is that it does not interfere with the user using other devices, such as the telephone. Further, unlike spot devices, the inventive apparatus can be more easily used by a person who operates many computers throughout a workday, as this person need only have one inventive apparatus to support his movements at any computer on which he may work.

While the invention has been described in detail and with reference to specific embodiments thereof, it will be apparent to one skilled in the art that various changes and modifications can be made therein without departing from the spirit and scope thereof. For example, the inventive apparatus could be used to support persons with disabilities who are performing other tasks in which they need additional support. Thus, it is intended that the present invention cover the modifications and variations of this invention provided they come within the scope of the appended claims and their equivalents.

What is claimed:

1. An ergonomic apparatus adapted to be worn by a user of a keyboard, comprising:

a central post, a shoulder assembly connected to an upper end of the central post, a waist bar having a front end and a back end, the back end of the waist bar connected to a lower end of the central post, and two palm rests each comprising a spoon shaped support attached to the waist bar, the shoulder assembly extending from the central post so as to be positionable over the user's shoulders and supported on the user's back without contact with the user's neck or upper and front shoulders, and the waist bar extending forward from the central post to provide support for the user's forearms and upper body, and the palm rests extending forward beyond the front end of the waist bar to provide support of the user's palms, wherein when the apparatus is in use, the shoulder assembly contacts the user's back, and the waist bar supports the user's forearms and upper body such that the user comfortably uses the keyboard in a manner which alleviates tension and stress when the user is engaged in keying the keyboard.

2. The apparatus of claim 1, wherein said central post is adjustable.

3. The apparatus of claim 1, wherein said central post comprises telescoping means for adjusting the central post.

4. The apparatus of claim 1, wherein said waist bar additionally comprises a wrist brace.

5. The apparatus of claim 1, wherein said waist bar additionally comprises a console.

6. The apparatus of claim 5, wherein said console is configured to communicate with a computer such that operating the console performs operations typically associated with a computer mouse.

7. The apparatus of claim 1, wherein said shoulder assembly is comprised of:

at least two members, wherein a first end of a first member is in contact with the user's back, a first end of a second member is in contact with the user's back, and a second end of the first member is in contact with a second end of the second member.

8. The apparatus of claim 7, wherein said first end of said first member and said first end of said second member are padded.

9. The apparatus of claim 7, wherein said second end of said first member and said second end of said second member are in contact with the central post.

10. The apparatus of claim 1, wherein shoulder assembly is comprised of a integral component having at least two shoulder branches, wherein said at least two shoulder branches are in contact with the user's back.

11. The apparatus of claim 10, wherein said shoulder assembly additionally comprises a central connection branch, and said center connection branch is in contact with the central post.

12. The apparatus of claim 10, wherein said at least two shoulder branches are padded.

13. The apparatus of claim 1 wherein the palm rests are adjustable in attachment to the waist bar.

* * * * *